US008596457B1

(12) United States Patent
Goblirsch et al.

(10) Patent No.: US 8,596,457 B1
(45) Date of Patent: Dec. 3, 2013

(54) SANDWICH HOLDER

(75) Inventors: Hope Goblirsch, San Mateo, CA (US); Michael J. Strasser, San Francisco, CA (US); Imraan Aziz, Oakland, CA (US)

(73) Assignee: Hope Goblirsch, San Mateo, CA (US)

( * ) Notice: Subject to any disclaimer, the term of this patent is extended or adjusted under 35 U.S.C. 154(b) by 0 days.

(21) Appl. No.: 13/465,423

(22) Filed: May 7, 2012

Related U.S. Application Data

(60) Provisional application No. 61/483,967, filed on May 9, 2011.

(51) Int. Cl.
*A45C 11/20* (2006.01)

(52) U.S. Cl.
USPC ..... 206/541; 206/804; 206/817; 220/629; 426/115; 221/192; 221/279; 221/56

(58) Field of Classification Search
USPC ..... 206/248, 126, 761, 229, 249, 254, 255, 206/556, 37.2, 37.54, 39.4, 817, 549, 559, 206/804, 541; 220/495, 495.03, DIG. 10, 220/629; 426/111, 112, 115; 221/56, 279, 221/192
See application file for complete search history.

(56) References Cited

U.S. PATENT DOCUMENTS

| | | | | | |
|---|---|---|---|---|---|
| 169,923 | A | * | 11/1875 | Roman | 206/126 |
| 693,621 | A | * | 2/1902 | Nash et al. | 221/279 |
| 1,089,889 | A | * | 3/1914 | Weston | 206/248 |
| 1,206,124 | A | * | 11/1916 | Meyers | 206/254 |
| 1,673,535 | A | * | 6/1928 | Sheehy | 206/761 |
| 2,248,843 | A | | 7/1941 | Atwood | |
| 2,293,655 | A | * | 8/1942 | Lane | 206/249 |
| 2,548,310 | A | * | 4/1951 | Jennings | 221/187 |
| 2,583,961 | A | * | 1/1952 | Nash et al. | 206/37.2 |
| 3,727,802 | A | | 4/1973 | Schnurmacher | |
| 4,500,145 | A | * | 2/1985 | Fassauer | 312/61 |
| 4,905,869 | A | * | 3/1990 | Grigsby et al. | 221/92 |
| 5,243,807 | A | | 9/1993 | Randlett | |
| 5,421,663 | A | | 6/1995 | Bravo | |
| 5,819,944 | A | * | 10/1998 | Terrasi | 206/534 |
| 5,860,587 | A | | 1/1999 | Young | |
| 6,261,611 | B1 | | 7/2001 | Berman | |
| 6,283,326 | B1 | * | 9/2001 | Lindsey | 221/279 |
| 6,779,664 | B1 | | 8/2004 | Bermann | |
| 7,007,829 | B1 | | 3/2006 | Mueller et al. | |
| 2010/0276311 | A1 | * | 11/2010 | Biondi et al. | 206/249 |

* cited by examiner

*Primary Examiner* — J. Gregory Pickett
*Assistant Examiner* — Mollie Llewellyn
(74) *Attorney, Agent, or Firm* — Loginov & Associates, PLLC; William A. Loginov

(57) ABSTRACT

This invention provides a holder for a sandwich that covers and protects the sandwich, and that allows an end of the sandwich to be exposed to the user while gripping the shell/housing. The holder includes an advancing mechanism that allows the sandwich end to be variably directed through an open end of the holder's shell/housing so that a portion to be eaten is exposed exclusively, while the remainder of the sandwich remains covered and isolated from the user's hands. In an illustrative embodiment, the holder and advancing mechanism is particularly suited to a small child's hands and associated motor skills. A flexible strip can extend from an actuation mechanism, such as a roller spool with an external knob assembly, around a plurality of guides to form a sling around a sandwich-holding base. Rotating the knob in an advance direction cause the strip to be drawn in, thereby raising the base.

11 Claims, 11 Drawing Sheets

SANDWICH HOLDER

RELATED APPLICATION

This application claims the benefit of U.S. Provisional Application Ser. No. 61/483,967, filed May 9, 2011, entitled SANDWICH HOLDER, the entire disclosure of which is herein incorporated by reference.

FIELD OF THE INVENTION

This invention relates to food-handling utensils and food containers, and more particularly to containers for sandwich-like food products

BACKGROUND OF THE INVENTION

For generations, sandwiches have been a lunchtime staple for small children at, and away from home. Sandwiches are often prepared on relatively soft breads in regularly sized slices. The contents/filling of these sandwiches ore often equally soft and sticky—for example peanut butter and jelly. Because children are often less attentive to cleanliness and hygiene, sandwiches often find there way to the floor or another potentially soiled/unsanitary surface. Likewise, a sandwich's soft and runny filling can wind up all over a child's hands, clothes face, etc. This often results because the child tends to grip the sandwich hard, and break through the bread layer while eating. The filling also runs out the sides of the sandwich and onto the child's hands. Children also often tend to eat around the perimeter of a sandwich, again creating an opportunity for more filling to run onto a child's hands.

More significantly, concerns over healthy eating have led parents to prepare sandwiches with less saucy contents and more loose, "whole" ingredients, like lettuce, tomatoes, pickles cucumbers and the like. These ingredients, while healthy, often tend to fall from the sandwich bread if not carefully tended while eating. This can prove a significant challenge for children during eating and for parents during the subsequent cleanup.

One way to avoid soiled hands, contaminated sandwiches and dropped fillings is to wrap the sandwich in a plastic or foil wrapper or sandwich bag, which is then gripped by the hands to protect the sandwich from fingers and maintain most of the sandwich in a covered state, with the contents generally contained therein. The diner then peels away enough of the bag/wrapper aside to expose an end of the sandwich to be eaten. As the sandwich is consumed, more of the wrapper is peeled away, exposing the next portion to be eaten, while the remainder of the sandwich is protected from contamination and contact with fingers by the unpeeled portion of the bag or wrapper. However, this can prove difficult for a small child as it requires a degree of dexterity and spatial awareness that may be beyond his or her ability to master. Moreover, a portion (or all) of the lightweight bag or wrapper can be inadvertently consumed by the child, giving rise to choking or another health risk.

It is, thus, desirable to provide a mechanism and associated technique for selectively covering all or a portion of a sandwich in a manner that allows only a portion to be eaten to be exposed. The mechanism should be child-friendly and easy to use and allow the entire sandwich to be consumed as desired. The mechanism should be sturdy and ergonomically suited to a small child's hands. The mechanism should also allow for ease of cleaning and refilling with new sandwiches having a variety of contents and a reasonable range of sizes. It is also desirable that the mechanism that maintains a child's interest and makes the process of eating the sandwich more enjoyable.

SUMMARY OF THE INVENTION

This invention overcomes disadvantages of the prior art by providing a holder for a sandwich that covers and protects the sandwich, and that allows an end of the sandwich to be exposed for eating by the user while gripping the shell/housing that surrounds the unexposed portion of the sandwich. In this manner the loose contents are less likely to fall from the sandwich and more likely to be consumed by the user. The holder includes an advancing mechanism that allows the sandwich end to be variably directed through an open end of the holder's shell/housing so that a portion to be eaten is exposed exclusively, while the remainder of the sandwich remains covered and isolated from contaminants and the user's hands. In an illustrative embodiment, the holder and advancing mechanism is particularly suited to a small child's hands and associated motor skills.

In an illustrative embodiment the illustrative advancing mechanism can include a flexible strip that extends from an actuating assembly, such as a roller spool with an external knob assembly, around a plurality of guides that form a sling around a sandwich-holding base. Rotating the knob in an advance direction cause the strip to be drawn in, and shortened, thereby raising the base. In alternate embodiments, the actuating mechanism can be any arrangement that allows the strip to move in each of opposing directions, such as a lever, slider, pull tab, or other hand-manipulated and/or automated linkage.

More particularly, in an illustrative embodiment, a holder for sandwich-like food products includes a rigid or semi-rigid shell having an enclosed volume and an exterior shape constructed and arranged to be grippable, the shell including an open top end. Within the shell is a base that moves upwardly between a bottommost position and a topmost position relative to the enclosed volume. This base is constructed and arranged to receive a bottom of the sandwich-like food product. A strip having a first end attached adjacent to a top edge of the shell and an opposing second end attached to a knob-actuated spool is provided within the volume. The strip is mounted so that it cradles the bottom of the base so as to selectively allow the base to move upwardly and downwardly as the spool is rotated in each of opposing directions, respectively. A removable top is mounted on the top edge of the shell, and is constructed and arranged to enclose an exposed portion of the sandwich-like product that extends outwardly beyond the top edge. A removable liner is also provided, which encloses the sandwich-like product on the bottom and sides thereof. The liner is attached adjacent to the top edge of the shell using a variety of attachment mechanisms that allow for removability to clean or replace the liner. The shell can include either a transparent or a translucent window, and the strip includes a graphic that moves with respect to the window as the spool rotates so that a moving scene can be viewed as the sandwich is advanced. The spool can also be interconnected with a pair of knobs located near the bottom of the housing, on opposite sides thereof—either or both knobs can be rotated to advance the sandwich within the holder. In an embodiment, the strip is threaded around the interior volume of the housing so that it extends from the spool to a first guide, along a first vertical portion to a second guide, adjacent to the top edge, around the second guide along a second vertical portion to a portion that wraps around a bottom of the base, and then to a third vertical portion that extends to the first end of the strip adjacent to the top edge of the shell. Also in an embodiment, the sandwich-like product is a conventional sandwich with a pair of commercially available, rectangular, bread-slices and filling therebetween, with the base and the shell constructed and arranged to enclose at least a portion of the sandwich. The shell and other components can be decorated in a variety of colors and surface finishes and constructed from a wide range of food-compatible materials.

In various embodiments, the removable liner can comprise a single or multi-use disposable liner similar or identical in form to a conventional sandwich bag with a clear, translucent or opaque finish on all or part of the liner. Alternatively, the disposable liner can define a custom form that is particularly suited to the shape, size and/or function of the sandwich holder.

In alternate embodiments, the shell can be a single piece or can be hinged to provide for cleaning. The advancing mechanism can include a ratchet mechanism that allows indexing of the knob. The advancing mechanism can alternatively comprise a gear assembly that moves a rack and pinion arrangement, frictional wheels or another type of rotating element mounted on the base. This rotating element interacts with a surface or structure formed on the shell to allow the base to move upwardly and downwardly within the shell. In a further alternate embodiment a gear or paddle-actuated scissors assembly can be used to advance and retract the base within the shell.

BRIEF DESCRIPTION OF THE DRAWINGS

The invention description below refers to the accompanying drawings, of which.

DETAILED DESCRIPTION

I. Overview

Figure 1:
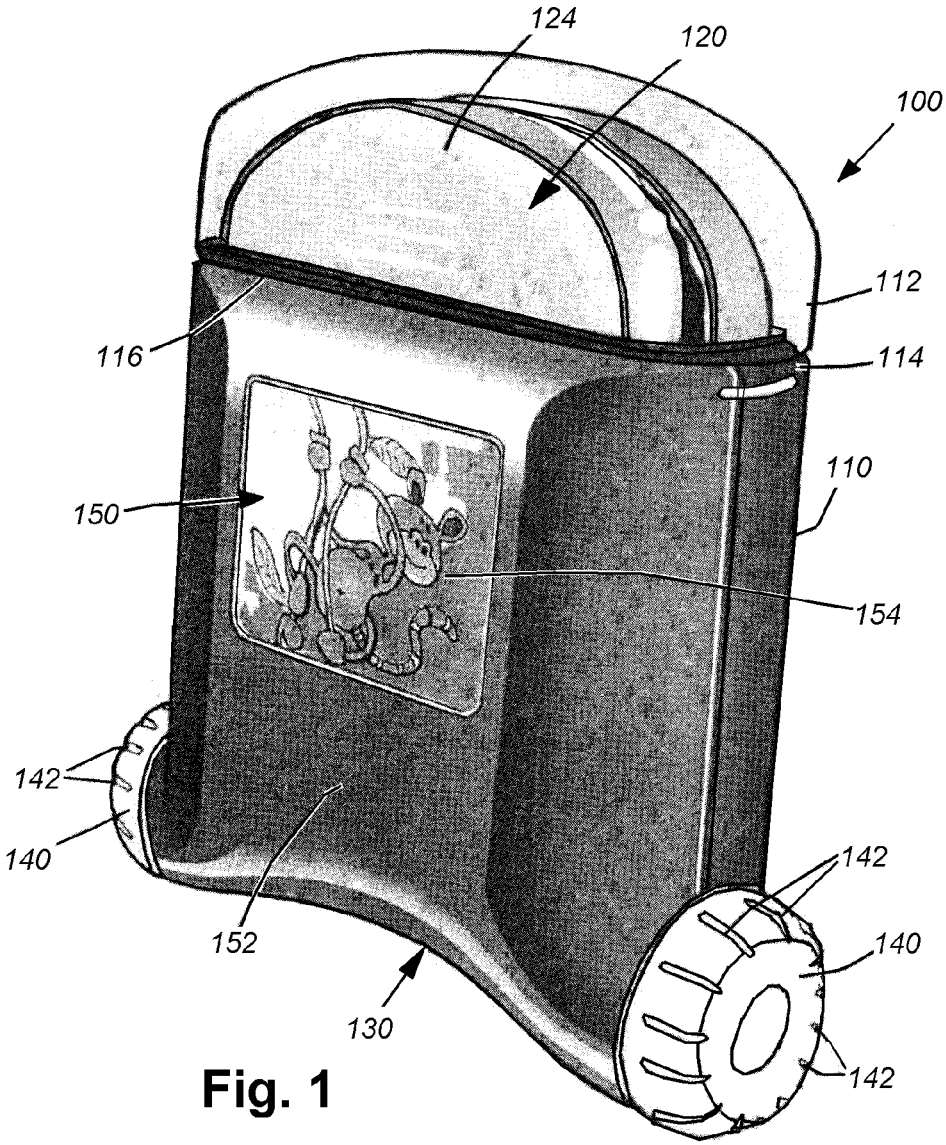
FIG. 1 is a perspective view of the exterior of a sandwich holder including an advancing mechanism and removable top cover according to an illustrative embodiment.

The various embodiments of a sandwich holder described herein allow a small child or another individual to grasp a solid outer shell that encloses the sandwich on all sides except a small portion that is exposed at an open top end of the shell. For further protection against contamination, and to maintain the sandwich's freshness, a removable cover (which can be transparent) can be placed over the open top shell, and in essence, provides for a sandwich container that can be carried, stored and otherwise handled without contaminating the sandwich or causing it to be crushed or damaged by grasping fingers. Each embodiment of the sandwich holder described herein includes an advancing (also termed a "lifting") mechanism that causes the sandwich to move incrementally within the shell so that as a portion of the sandwich is eaten, a new portion can be advanced up to take its place. This new portion is subsequently eaten. The advancing mechanism can be constructed using a wide variety of techniques and materials, and employing various mechanical arrangements. The mechanism is generally user-friendly, low-maintenance and easy to clean (or is isolated from the sandwich so as to avoid the need of cleaning). According to various embodiments, the sandwich can be isolated from the internal mechanism by a replaceable liner, similar to a conventional sandwich bag, but typically constructed from a thicker polymer material. The liner folds up as the advancing mechanism moves the sandwich upwardly out of the open top end of the housing shell.

Note that as used herein directional/orientational terms such as "up", "down", "front", "rear", "vertical", "horizontal", "top", "bottom" and the like should be taken only as relative conventions and not as absolute directions with respect to a given reference system, such as the acting direction of the force of gravity.

More generally, the various sandwich holder embodiments contemplated herein allow the user to grip the rigid housing shell in a manner free of directly contacting the sandwich. This enhances hygiene and cleanliness, and ensures that the sandwich is eaten in a generally orderly manner.

II. Sandwich Holder with Lifting Strip Mechanism

With reference to FIGS. 1-5, a sandwich holder 100 according to an illustrative embodiment is shown and described. The sandwich holder 100 is shown fully assembled in FIG. 1. In overview, it consists of an outer shell 110 constructed from a durable and generally rigid polymer material such as polycarbonate, acrylic, polystyrene, or another acceptable, non-toxic and food-utensil-compatible material. Alternate materials that include some flexibility, or materials that are combined with a non-skid coatings, such as soft PVC can also be employed. Likewise, the housing can include various forms of textured surface to enhance gripping by a user. A transparent (or translucent, opaque, etc.) top 112 is attached to the top edge 114 of the shell 110. The top 112 can include shoulders or other carrying structures along its open edge 116 that interengage with a lip on the shell's top edge 114. As shown, a sandwich 120 is contained within the holder in a normal position for consumption. In this position, approximately 1½ inches of the sandwich (an exposed portion 124) protrude above the top edge 114. The sandwich 120 is exemplary of any approximately similarly-shaped food product that can be contained within the holder.

At or near the bottom end 130 of the shell 110, there is a pair of knobs 140 on opposing sides of the housing with crenellations 142 that facilitate the user's grip while turning/rotating. In an embodiment, the knobs 140 can be between approximately ½ inch and 1½ inches in diameter. The knobs in this embodiment are round in perimeter shape, but oblong and irregular shapes, as well as polygonal shapes, can be employed in alternate embodiments. As described below, rotating the knobs facilitates the raising and lowering of the sandwich contained within the shell. In this manner, an exposed portion 124 of the sandwich is positioned above the top edge 114 of the housing shell 110 so that it is available to be bitten down upon, and consumed, by the user. A window 150 constructed from a transparent polymer material is provided along the front side 152 of the shell. The window exposes a graphic 154 which, in this case, is a fancifully styled monkey on a vine. Any user-appropriate graphic can be employed (for example, clowns, trains, birds, etc.). As described below, the graphic can be printed so that it moves from one frame/scene to another, or so that it presents a continuous scene, as the advancing mechanism is moved to raise/lower the sandwich 120. By way of example, a continuous scene can comprise a tree and long vine with a number of monkeys in different poses appearing along its length as the advancing mechanism is moved.

Figure 2:
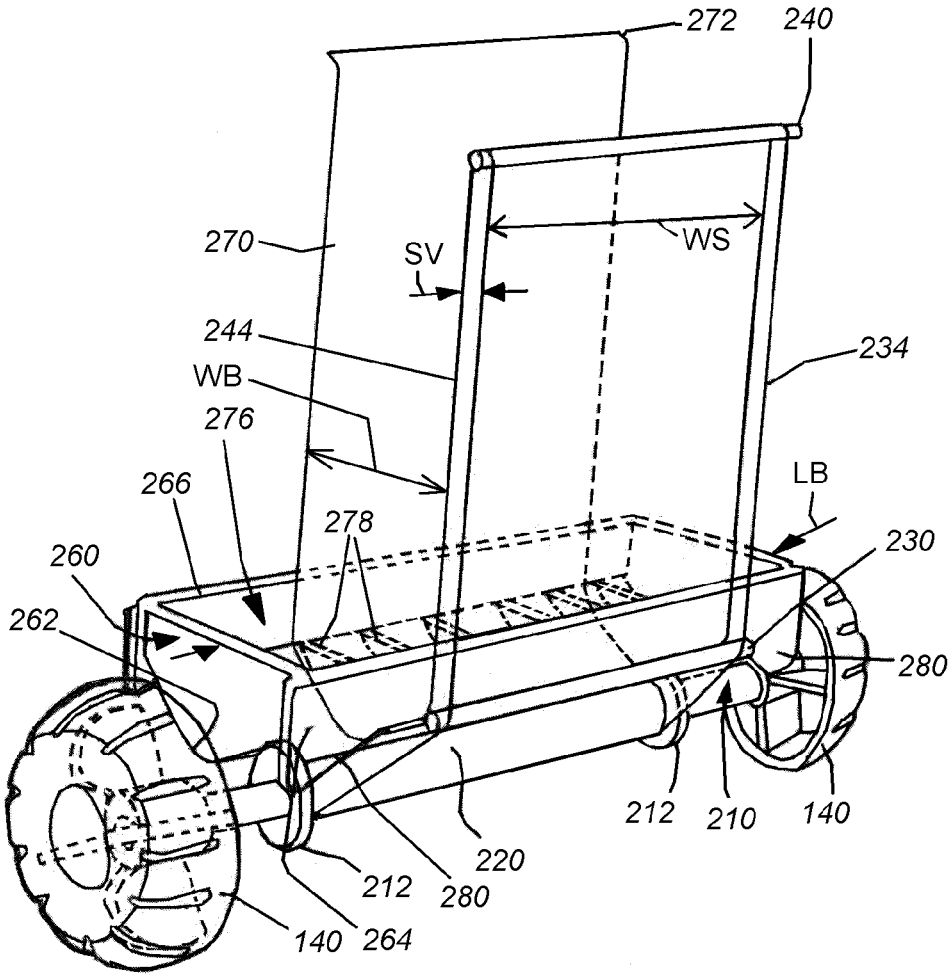
FIG. 2 is an exposed perspective view of the advancing mechanism of the sandwich holder of FIG. 1.

With reference now to FIG. 2, the advancing mechanism is shown in further detail. In general, the knobs 140 are mounted on the common axle 210 that passes through the bottom of the shell. The axle 210 includes a pair of flanges 212 that provide spool ends for centering and containing a flexible polymeric strip 220. The strip 220 can be constructed from any acceptable, durable, flexible material, such as commercially available polyester/polymer films, or any other acceptable material that is capable of resisting a modest tensile force while remaining substantially free of stretch (elastic deformation). The strip is anchored at one end to the axle 210 so that rotating the knobs 140 causes the strip 220 to wind and unwind with respect to the spool. This can be accomplished by threading the strip end through a slot, or by attaching it using adhesive/welding (or by another attachment technique). A guide roller or shoulder 230 is mounted to the inside face of the front wall of the shell using an appropriate base structure (not shown). The roller/shoulder 230 can be stationary or rotatable within its base. It is arranged to direct the strip from the spool (which is generally centered within the shell to a location adjacent to the inside face of the front wall 152 of the shell. This redirected portion 234 of the strip 220 extends vertically upwardly along the wall to a top roller or guide 240 (stationary or rotatable) that is mounted near the top edge 114 of the shell 110. The strip 220 is wrapped around this roller 240 and redirected approximately 360 degrees so that a downwardly directed vertical portion 244 runs parallel to the upwardly directed portion 234. The two vertical portions 234, 244 are spaced from each other at a spacing SV of approximately 1/16 to 3/16 inch. The downwardly directed strip portion 244 extends beneath a sandwich base 260. The sandwich base 260 includes a curved bottom surface 262 that guides the strip from one side 264 of the base 260 to an opposing side 266 of the base 260. In this manner, the base 260 is cradled along its bottom end by the strip 220. The strip 220 again extends from the base with a vertical portion 270 running upwardly along the opposing inner surface of the shell 110 to an anchor point 272, where it is secured to the shell by clips, adhesives, welding or any other acceptable attachment technique.

The threading and geometry of the strip 220 enables the opposing raised portions 244 and 270 form a sling that cradles the base 260. The opposing strip portions 244 and 270 are spaced apart by a distance that conforms to the base width WB. The width WB is sufficient to allow a conventionally-sized sandwich (for example, having a width of between approximately 1" and 1½") to be positioned in the base so that its bottom end is contained by the base's well 276. The well 276 is formed by a series of upright walls as shown. In this embodiment, the base 260 also encloses a series of strengthening ribs that form a flat surface for supporting the sandwich and reinforce the curved bottom of the base. Because the bottom of the base is curved (semi-cylindrical, for example), it allows for relatively resistance-free sliding of the strip 220 over its surface. The strip 220 and the base bottom have a relatively low-friction finish that further facilitates resistance-free sliding motion between the surface and the strip. Thus, when the knobs 140 are rotated to rotate the axle 210, the strip 220 is responsively drawn-up or paid-out (depending on the direction of axle rotation). This causes the overall length of the strip to vary. As such, the sling formed between the strip portions 244, 270 raises or lowers to, in turn, either raise or lower the sandwich base 260 within the shell 110.

In an illustrative embodiment, the horizontal length LB of the base 260 (along an elongated direction) is variable. In general, it should be long enough to accommodate the width of a conventional piece of sandwich bread in an embodiment with a length LB is at least 4-5 inches. However, longer or shorter dimensions are expressly contemplated in alternate embodiments. On each end of the base, in the elongated direction, there is an outwardly-projecting leg 280. Each leg 280 is approximately triangular in shape, and is located with respect to the base end so that it does not interfere with the continuous curve of the central region of the base where the strip is positioned, but serves to maintain the strip centered within this central region in the same manner as the spool flanges 212. The legs are constructed and arranged to provide a stop that prevents the base from coming into direct contact with the moving mechanism of the spool. The legs engage with structures on the inside of the shell to guide the stopping action. The width WS of the strip is highly variable. In an embodiment, the strip 220 is between approximately 2 and 3 inches in width. Strips having differing widths are expressly contemplated, and the flanges 212 and legs 280 can be formed to accommodate that particular strip width.

Figure 3:
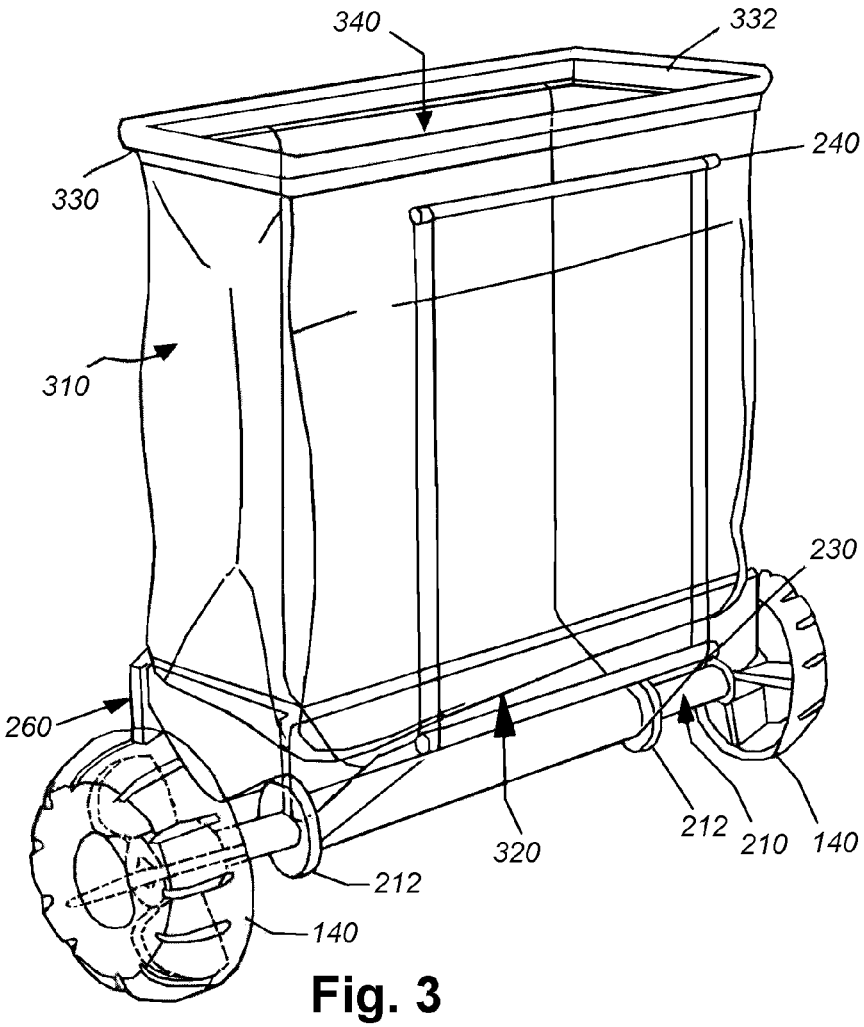
FIG. 3 is an exposed perspective view of a replaceable liner in combination with the advancing mechanism of the sandwich holder of FIG. 1.

With further reference to FIG. 3, an inner liner 310 is shown. The inner liner 310 extends from an enclosed liner bottom 320 that is seated within the well 276 of the base 260 to a top edge 330 that engages the top of the shell 110. The liner 310 can include a flexible rim 332 that is built into the liner, and that resides within a well formed in the top of the shell. A variety of attachment arrangements can be employed to secure the liner 310 to the top of the shell. These attachment arrangements can include clips, flexible bands, gaskets, and other mechanisms known to those of skill in the art. In general, the liner 310 is constructed from a durable, but flexible material such as polyethylene, PVC, PET, or another food-compatible resilient sheet material. As shown, the liner 310 is sealed on the bottom and all four vertical sides, and open only at the top end 340. Its flexibility allows it to compress and form an inwardly/outwardly folded shape as the base 260 is raised by the strip 220 of the advancing mechanism. In this manner, the liner 310 does not interfere with the raising or lowering of the base, but ensures that there is a continuous seal/isolation between the sandwich storage compartment created within the liner and the surrounding interior space of the holder shell. Thus, the advancing mechanism and its environs will not become contaminated by sandwich debris (i.e. crumbs and filling) that can fester into a bacteria colony. Likewise, the sandwich is free of contact with any potential contaminants within the shell due to the isolating effect of the liner. The liner 310 is removable for cleaning, or can be cleaned in situ without removal. It is also replaceable with a new, replacement liner when worn out or at a predetermined replacement interval (for example after X weeks/months of continuous use). Overall, the liner 310 ensures a cleaner and more bacteria-free environment.

In various embodiments it is also expressly contemplated that the liner can comprise a single-use or multi-use, disposable component that can be similar or identical to a conventional clear polymer sandwich bag. The bag-like liner can be attached to the rim of the shell 110 using any acceptable technique. For example, it can include an open top edge that is capable of being folded over the rim so as to secure it in place in the manner of a trash can liner (for example, in FIG. 4 see line 450 showing liner 310 attached adjacent to the top edge 114 of the shell 110). It can include various tabs and other attachment members that should be clear to those of skill in the art. The polymer material (e.g. a sheet material) forming such a disposable bag like liner can be similar or identical to the material used in conventional sandwich bags or it can be a custom-designed material. The material can be fully or partially clear, translucent and/or opaque. In operation, a user places the disposable liner into the shell and secures it to the rim (or another location on the shell). The user then inserts the sandwich and uses the mechanism as described herein. When at least one use is complete, the user removes the liner and simply disposes of it. Liners can be contained on a roll or as a stack in an appropriate package (e.g. a cardboard box) in a manner known to those of skill.

Figure 4:
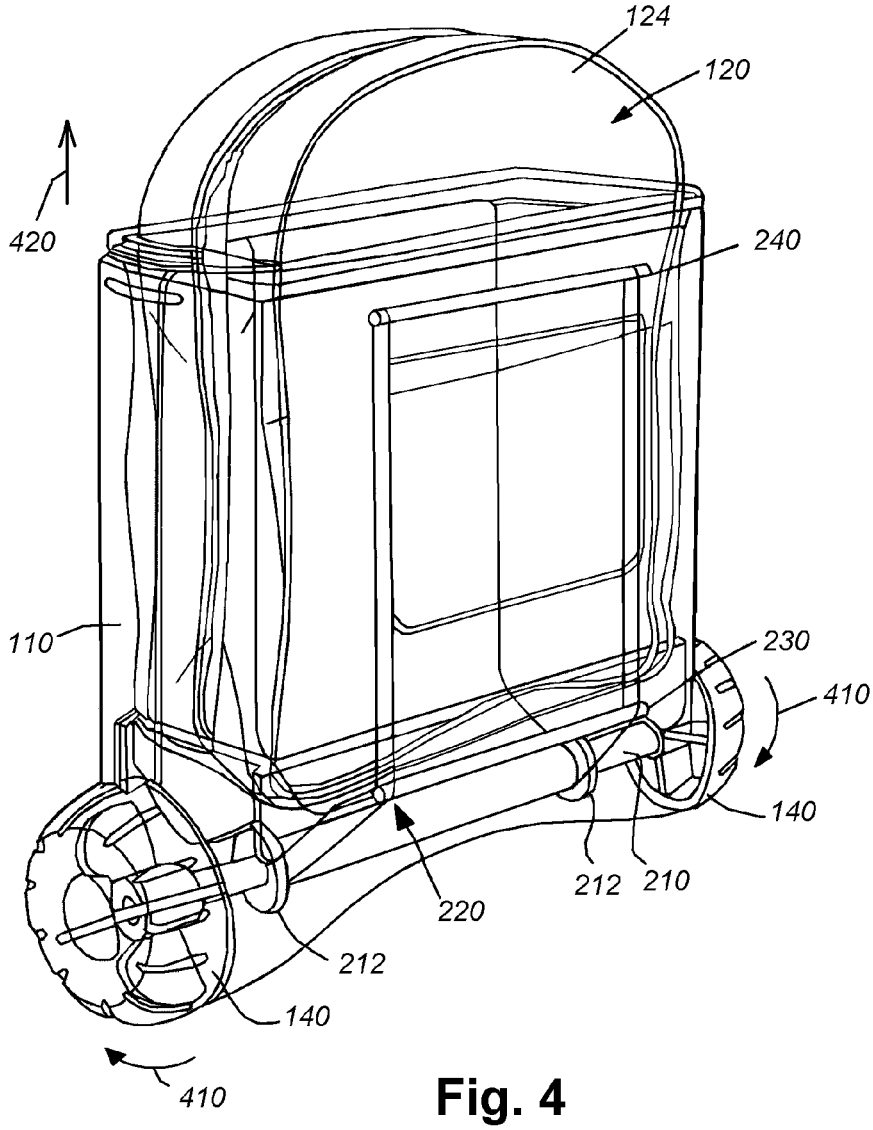
FIG. 4 is an exposed perspective view of the sandwich holder of FIG. 1 including the outer shell with an exemplary sandwich inserted in the replaceable liner and projecting from the top end of the shell.

As shown in FIG. 4, the exemplary sandwich 120 is placed within the assembled holder (with the outer shell 110 shown in exposed view). In operation, as the exposed top portion 124 of the sandwich 120 is consumed, the knobs 140 can be rotated (curved edge 410) to shorten the strip 220, and thereby raise (arrow 420) the sandwich 120 so as to expose more of the remaining portion. When the base is fully lowered it allows approximately 3 to 4 inches of the sandwich to be covered with approximately 1 to 1½ inches exposed. However this is only illustrative. In general, younger children may require the help of a parent to advance the sandwich properly. Older children, in all likelihood, can perform this action on their own. While not shown, the axle 210 can include a ratcheting mechanism that secures it at an appropriate rotational position after the knob has been turned. Any acceptable latching mechanism could be employed. Such latching mechanisms can be unidirectional or bidirectional. For example, the ratchet can be adapted to allow the sandwich base to be advanced upwardly, but activation of a ratchet a release button can be required to lower the base back to its initial position in the bottom of the shell. Alternatively, the ratchet mechanism can be an indexing mechanism using (for example) a series of detents on the axle assembly and a spring-loaded ball that allows a clicking movement of the knob, and in which a predetermined amount of torque can overcome each ratchet action. Such a clicking mechanism can provide a pleasing feedback to a child stimulating his or her oral and tactile senses.

While a spool and knob assembly is employed to move the attached end of the strip in each of opposing directions according to an illustrative embodiment, it is expressly contemplated that the free end of the strip can be moved (i.e. taken up or let out to, in turn, raise or lower the sandwich base) using other types of actuation assemblies/mechanisms. These actuators can, for example, comprise sliders, levers, pull tabs on the end of the strip, and/or other manually operated components that allow the user to manipulate the strip via a graspable component. By way of example, in an alternate embodiment, the strip end can be attached to a slider that rides in a vertical groove provided in the shell. Likewise, it is contemplated that the actuation mechanism in this embodiment, or others described herein can include an electromechanical (or another motive force, such as pneumatic) actuator. For example, a battery operated motor and interconnected switch can be used to operate the spool assembly via a gear transmission or other operative connection.

Figure 5:
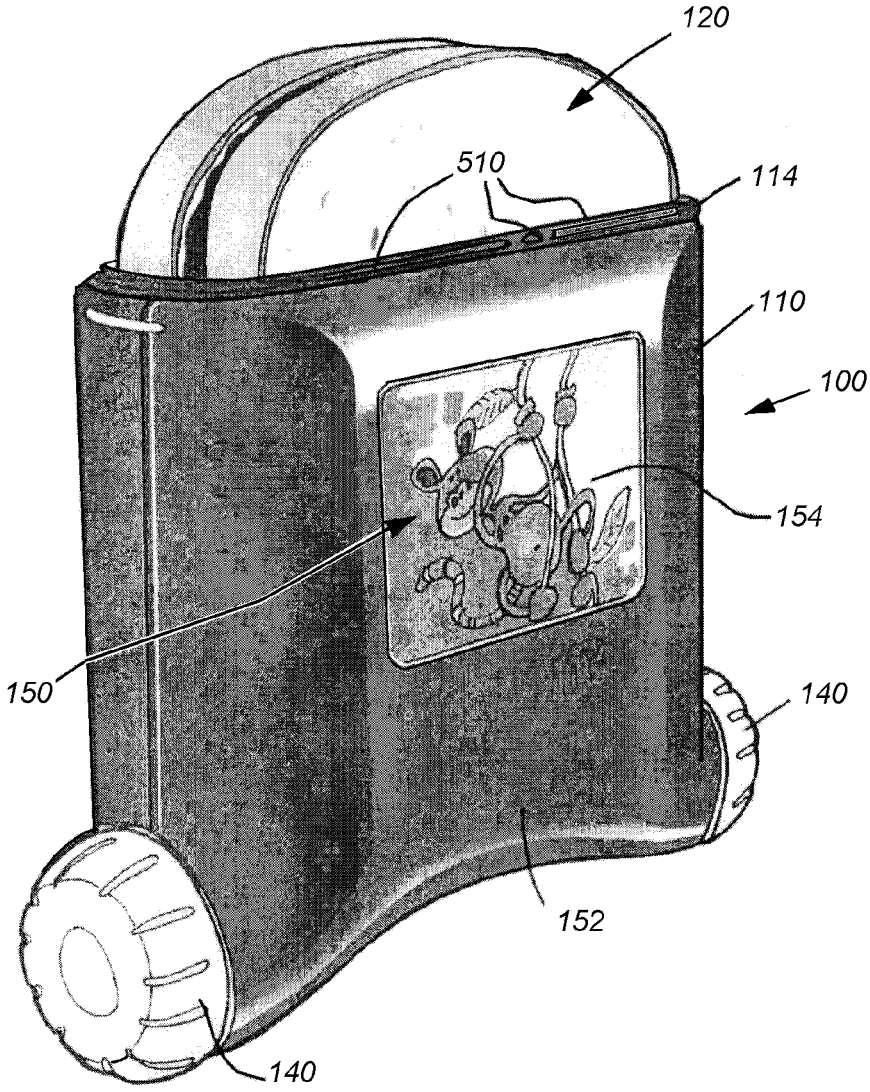
FIG. 5 is a perspective view of the sandwich holder of FIG. 1 showing the top cover removed to expose an end of the exemplary sandwich through the open top end of the shell.

As shown in FIG. 5, the complete, assembled sandwich holder 100 is again depicted with the top cover 112 removed to expose the exemplary sandwich 120, ready for consumption. It should be clear that the knobs 140, shell 110 and top 112 can be decorated in a variety of pleasing colors and/or printed patterns. As described above, the graphic 154 within the window 150 is printed (or otherwise applied) on the strip 220 so that it appears along the strip's vertical portion 234 that is closest to the inside face of the front wall 152. By way of example, this graphic can be part of a continuous image that changes as knobs are rotated (and the strip is drawn into the spool), or the graphic can comprise a variety of discrete image frames, each with a particular view, subject and/or theme. In alternate embodiments, a plurality of transparent/translucent windows can be provided along the side of the shell so that a number of different images can be viewed at any given time. Note that the use of a window and graphic is optional and that in alternate embodiments, the strip can be cured by an opaque shell. In alternate embodiments, the shell can be translucent (e.g. tinted in a particular shade(s) or color(s)) so that a separate window is not employed to view a graphic placed upon the strip or upon another portion of the interior of the shell.

As described above, the top 112 can be snap-fit onto the top edge 114 of the shell 110. As shown in FIG. 5 that a series of circumferential shoulders or detents 510 are illustratively provided to the top edge 114 to allow for interengagement with conforming structures the top's edge. This interengagement between shoulders allows for a secure, but readily detachable, snap fit of the top cover 112 to the shell.

Figure 6:
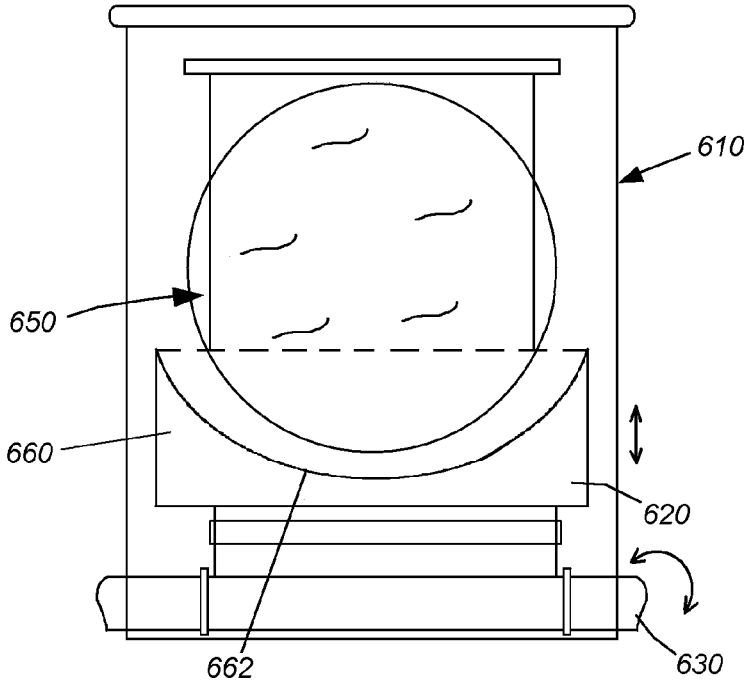
FIG. 6 is an exposed side view of a sandwich holder including a contoured sandwich base for accommodating circular bread slices.

While the embodiment described in FIGS. 1-5 is adapted for use with sandwiches prepared from somewhat-conventional, pre-sliced rectangular bread slices, it is contemplated that the sandwich holder can be adapted to accommodate a variety of different bread shapes in accordance with the various embodiments of this invention. With reference to FIG. 6, a sandwich holder 610 is shown in a partially exposed side view. The sandwich holder includes an illustrative lifting strip 620 similar to that described in the above embodiment. The strip 620 wraps around an axle 630. In this embodiment, the exemplary bread 650 is formed with a circular or ovular shape. It can prove problematic to accommodate such a shape using a flat-bottomed sandwich base as described above. Thus, a base 660 having a semi-circular well bottom 662 is provided in this embodiment. The curve of the well bottom 662 is defined so as to accommodate various commercially available types of round bread. In an embodiment, the curved well bottom can be provided as an insert for the conventional flat bottomed base well 276 described above. The insert can reside between the base and the liner. In further embodiments, a variety of inserts, each having a differing geometry, can be provided to the user with the holder, or can be purchased separately, depending on the desired type of bread to be used. Likewise, an insert blank formed from a soft, formable material, such as Styrofoam, can be used by the user to form a customized base well shape. For example, the blank can be cut to shape with a scissor or knife. Since it resides between the base and the liner, there is little or no risk of contamination of the sandwich by any remaining loose excess material remaining on the custom formed insert.

Figure 7:
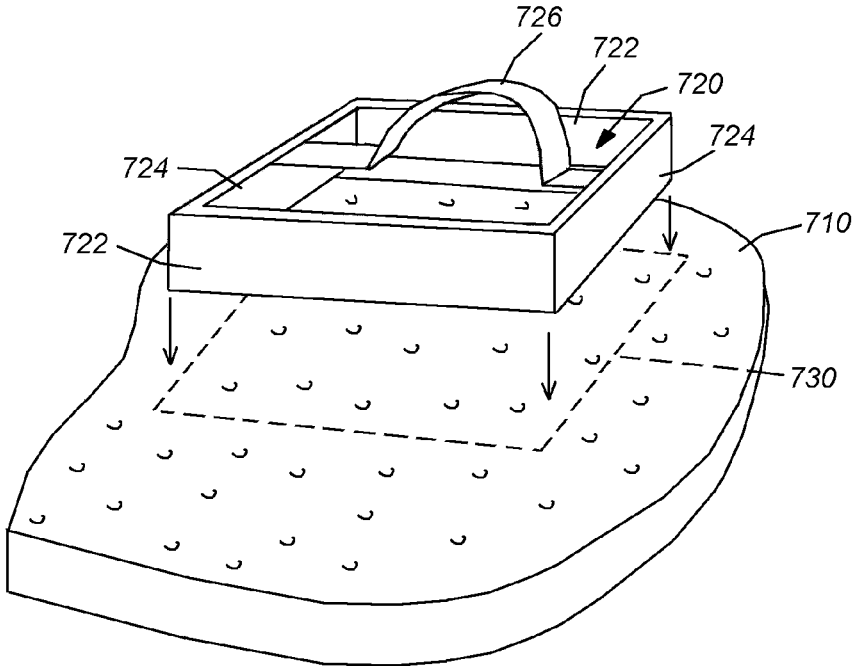
FIG. 7 is a perspective view of a cutting die for forming an exemplary shape from one or more bread slices so as to conform to the geometry of the illustrative sandwich holder.

It is also contemplated that some breads may prove too large or too irregular in shape to properly fit within the sandwich holder's enclosure. With reference to FIG. 7, an oversized bread piece 710 is shown. An optional cutter 720 can be employed to trim the bread piece 710 to the desired geometry 730 (shown in phantom) for optimal fit within the holder. The cutter 720 can be constructed similar to a cookie cutter with a rectangular arrangement of upright, relatively thin walls 722, 724 that are (optionally) tied together by a handle 726. The walls 722, 724 can include a chisel-shaped bottom edge structure that facilitates cutting of the bread with minimal pressure. The walls can be constructed from metal or durable plastic as appropriate. The cutter ensures that any form of bread can be used in conjunction with the sandwich holder after forming it into a predetermined shape that is particularly suited for insertion into the holder.

III. Alternate Embodiments

The above-described sandwich holder and associated advancing mechanism provides an effective and relatively straightforward mechanism for containing and dispensing a sandwich. This embodiment is illustrative of variety of possible arrangements and implementations for the shell and advancing mechanism contained therein. It is expressly contemplated that other arrangements and implementations of an advancing mechanisms and related structures can be employed in alternate embodiments. The following is a description of various alternate implementations for a sandwich holder and associated advancing mechanism that can be provided as an alternate embodiment with respect to the above-described sandwich holder. It is expressly contemplated that the various features of the shells and advancing mechanisms described below can be combined with the features of the above-described holder, or with each other to achieve the desired combination of features and functionalities.

Figure 8:
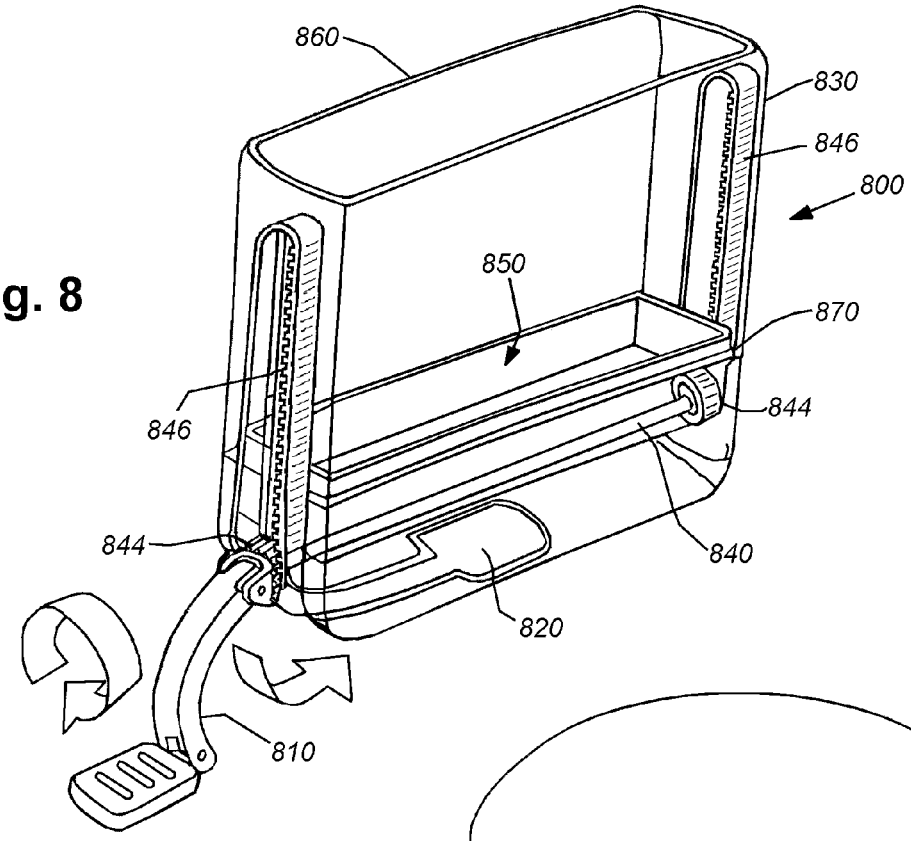
FIG. 8 is an exposed perspective view of a sandwich holder having an advancing mechanism including a crank and gear mounted to the sandwich base that rides within a rack in the side of the shell, according to an alternate embodiment.

With reference to FIG. 8, a sandwich holder 800 having a retractable crank mechanism 810 is provided. The crank mechanism 810 resides within a well 820 within the bottom of the holder shell 830 when not in use. When deployed as shown, the crank mechanism operates an axle 840 with a pair of gears 844 on opposing ends thereof. The gears 844 engage racks 846 formed on slots that extend vertically along the opposite sides of the shell. As the gears rotate, they interact with the shell's racks to raise and lower a base 850, which is interconnected with the axle 840 by appropriate bearing bases. This allows for advance and withdrawal of the sandwich with respect to the open top edge 860 of the holder shell 830. In an embodiment, the base 850 includes a wiper or seal 870 mounted around its perimeter that engages the inner wall of the shell 830. This seal 870 reduces the amount of contamination that can migrate the bottom of the shell. In alternate embodiments, a liner and/or top cover can be employed as described above.

Figure 9:
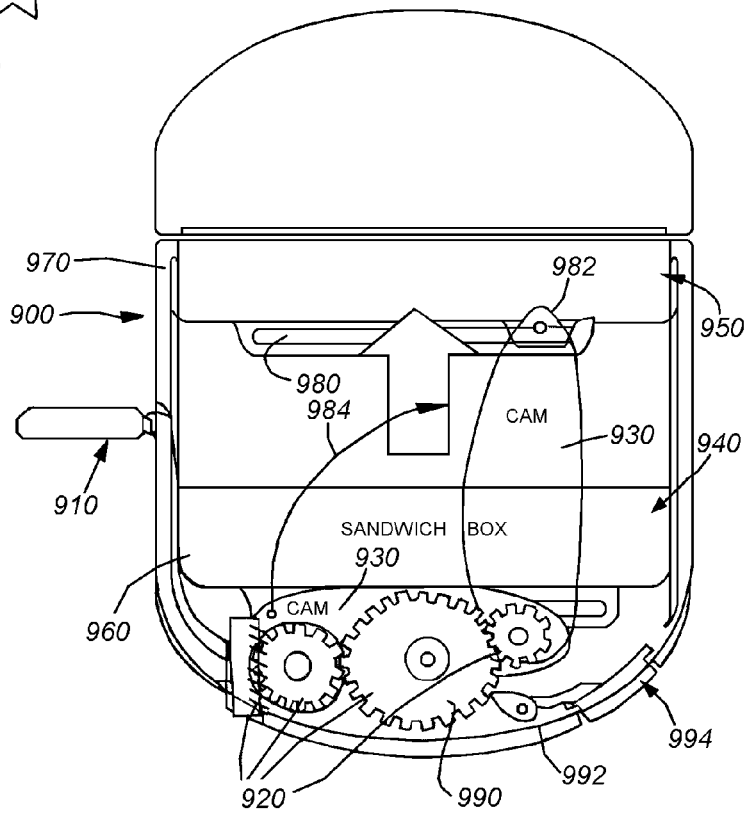
FIG. 9 is an exposed perspective view of a sandwich holder having an advancing mechanism including a crank and gear train that operates a cam, which is slidably mounted to the sandwich base mounted to the sandwich base, according to an another alternate embodiment.

An alternate embodiment of a crank-operated sandwich holder is shown in FIG. 9. This sandwich holder 900 employs a crank mechanism 910 having a series of interconnected gears in an assembly 920 that operates a moveable cam 930. The cam is shown in both a fully withdrawn (940) and a fully extended position (950), respectively. In each position, the sandwich base 960 is located at an appropriate position within the shell 970. The base 960 includes a slotted rib 980 formed along the bottom side of the base 960. A pin 982 mounted on an end of the cam swings along an arc (curved arrow 984) as the crank 910 is rotated, as shown. The pin 982 rides within the slotted rib 980 to raise and lower the sandwich base. As described generally above, the sandwich holder of various embodiments herein can include a ratcheting mechanism. In this embodiment, the illustrative ratcheting mechanism comprises a cog and pawl assembly. The depicted gear assembly 920 include a main cog 990 that interacts with a pawl 992. The pawl 992 is mounted on the end of a button 994 that projects through an orifice in the bottom of the shell. When extended, the pawl 992 engages the cog 990 and restricts downward movement of the base 960 once it is advanced toward the top. The pawl pivots to allow the cog to rotate freely in the advance direction, but restricts rotation in the withdrawal direction. However, when the button is pressed, the pawl 992 is retracted from engagement with the cog 990. This allows release of the base 960 so that it can be returned to the original downward position (940). It is expressly contemplated that this ratchet mechanism can be implemented in other embodiments, and that the depicted ratchet mechanism is only illustrative of a wide variety of ratchet mechanism implementations that can be employed.

Figure 10:
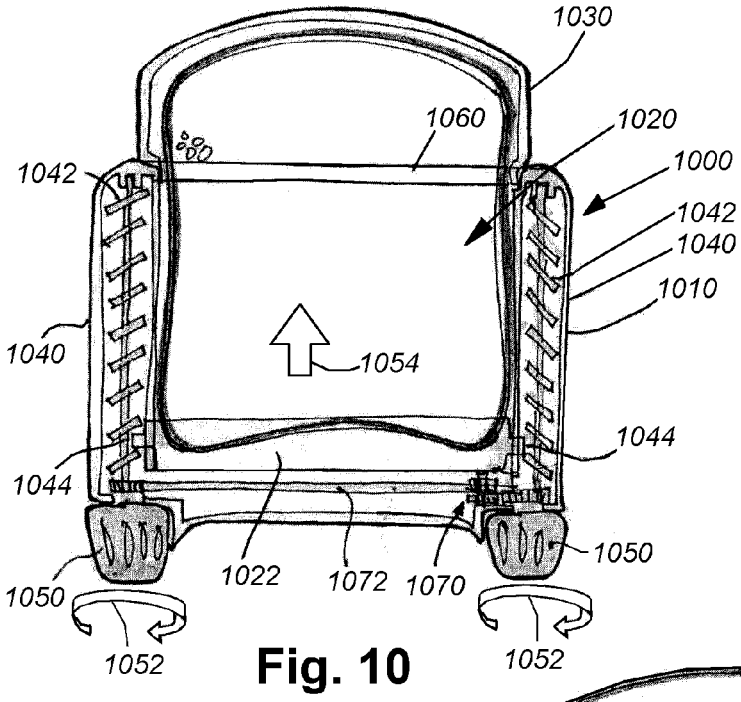
FIG. 10 is an exposed perspective view of a sandwich holder having an advancing mechanism including a pair of rotating screws that capture ends of the sandwich base, according to an another alternate embodiment.

With reference now to FIG. 10, another alternate embodiment of a sandwich holder 1000 is shown and described. This holder 1000 includes a shell 1010 that defines a central compartment in which the sandwich 1020 is enclosed. As shown, the sandwich is placed on a moving base 1022 that includes an appropriate well shape for surrounding the bottom of the sandwich 1020. While not shown, a liner can be provided between the enclosure/base. Alternatively, the base 1022 can include a wiper/seal mounted on its perimeter that prevents migration of contaminants into the interior of the shell 1010. The shell 1010 includes a pair of side-mounted protuberances 1040 that work a pair of helical screw members 1042. The helical threads of screw members are generally flat, and define a spacing and pitch that is adapted to engage ends 1044 of the base. Thus, when the screws are rotated (curved arrows 1050) via knobs 1050, the base 1022 can be driven upwardly (arrow 1054) to advance the sandwich's top beyond the top edge 1060 of the shell 1010. In order to synchronize movement of the screw members 1042, a gear assembly 1070 and an interconnecting belt 1072 rotatably join the two knobs 1050 and associated screw members 1042 together. In an alternate embodiment, one of the knobs can be omitted, and both screw members 1042 can be rotated by a single knob in conjunction with the lower end of the belt assembly. In a further alternate embodiment, a screw member can be provided to one side only, or at a central location, and appropriate guides can be used within the shell to maintain alignment of the housing as it is raised and lowered. Also, while a belt 1072 is used to interconnect the two knobs 1050 in this embodiment, it is expressly contemplated that another type of transmission assembly, such as an axle assembly, can be employed in alternate embodiments.

Figure 11:
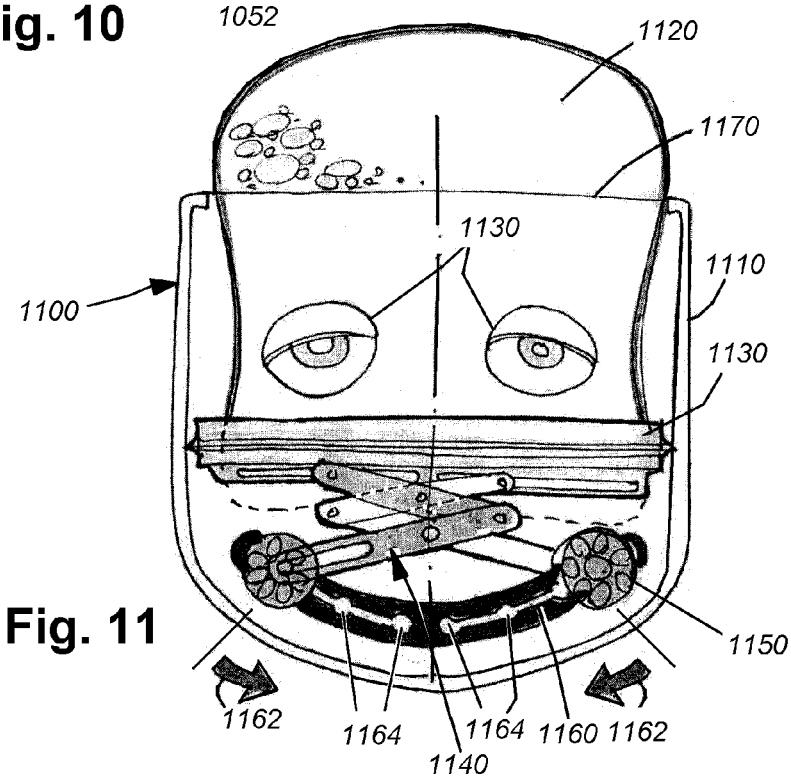
FIG. 11 is an exposed perspective view of a sandwich holder having an advancing mechanism including a pair of moving knobs that index a scissors linkage which is attached to the sandwich base, according to an another alternate embodiment.

With reference to FIG. 11, yet another style of sandwich holder 1100 is shown. This holder 1100 includes a shell 1110 that houses the exemplary sandwich 1120. In this embodiment, a graphic 1130 is provided to the exterior of the shell, or to the interior of the shell (e.g., where the interior is translucent). The depicted (exemplary) "sad-eye" graphic can be employed in other embodiments herein and provides an anthropomorphic effect to the sandwich and underlying holder. The base 1130 is supported by an advancing mechanism that comprises a scissors assembly 1140. This assembly 1104 includes a pair of knobs 1150 (that pass through the shell), which can be moved along a slotted slide base 1160 (arrows 1162). The slots are each shaped as an arc in this embodiment. A series of enlarged holes 1164 are provided along each arcuate slot so as to define index points for the mechanism. Each index point can conform to a given advance distance for the top end of the sandwich 1120. That is, each time the knob is moved and seated in a given hole 1164, the sandwich has been moved a predetermined amount that is relevant to allow consumption of that portion of the sandwich, without extending the sandwich too far out of the top edge 1170 of the shell 1110. The slot can be replaced with a curved rack in which the knobs are rotated along that rack to advance and retract the scissors. However, in this embodiment, the knobs are (for example) pulled out to allow movement between holes and then reseated within a given hole. Note that each side of the scissors engages the base 1130 via a pin and slot so that the scissors ends can move toward and away from each other as the assembly respectively extends or retracts.

Figure 12:
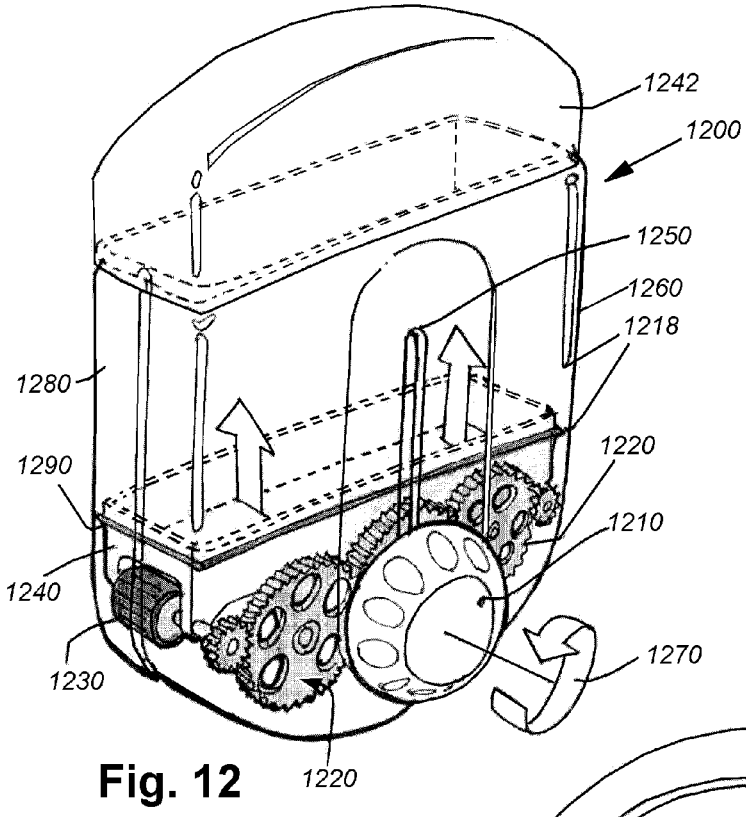
FIG. 12 is an exposed perspective view of a sandwich holder having an advancing mechanism including a knob and gear train that drive rollers on opposing ends of the sandwich base to move it along the inner surface of the shell, according to an another alternate embodiment.
Figure 13:
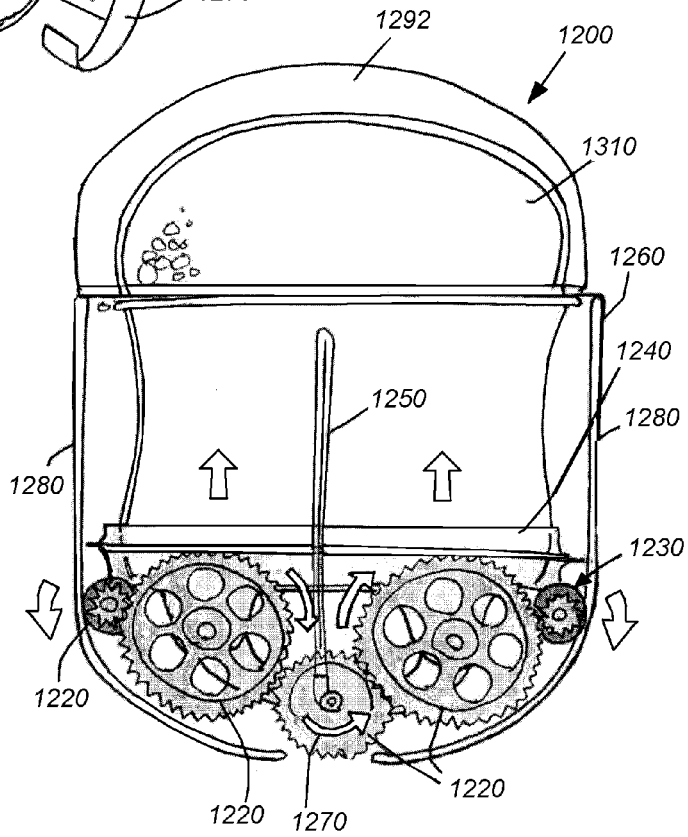
FIG. 13 is an exposed side view of the sandwich holder of FIG. 12 further detailing operation of the gear train.

FIGS. 12 and 13 show a sandwich holder 1200 according to yet another embodiment in which a central, side-positioned knob 1210 operates a gear assembly 1220 that interconnects with a pair of roller 1230. The rollers 1230 and gear assembly 1220 are all fixedly mounted to the upwardly/downwardly moving base 1240 within the shell 1260. A vertical slot 1250 formed in the front wall of the shell 1260 allows an axle connected to the knob 1210 to pass vertically with respect to the shell into the base 1240. In this manner, as the knob is rotated (curved arrow 1270), the interconnected gear assembly 1220 rotates the rollers 1230. The rollers 1230 engage a smooth, rough or geared surface on each interior sidewall 1280 of the shell 1260 and thereby cause the base to ride along the side walls 1280 of the shell. A seal 1290 and/or a liner are used to isolate the mechanism from the enclosed sandwich 1310. A removable top 1292 can also be employed as described above. The rollers 1230 can be provided with an elastomeric tire, or another frictional surface that firmly engages the sidewalls 1280.

Figure 14:
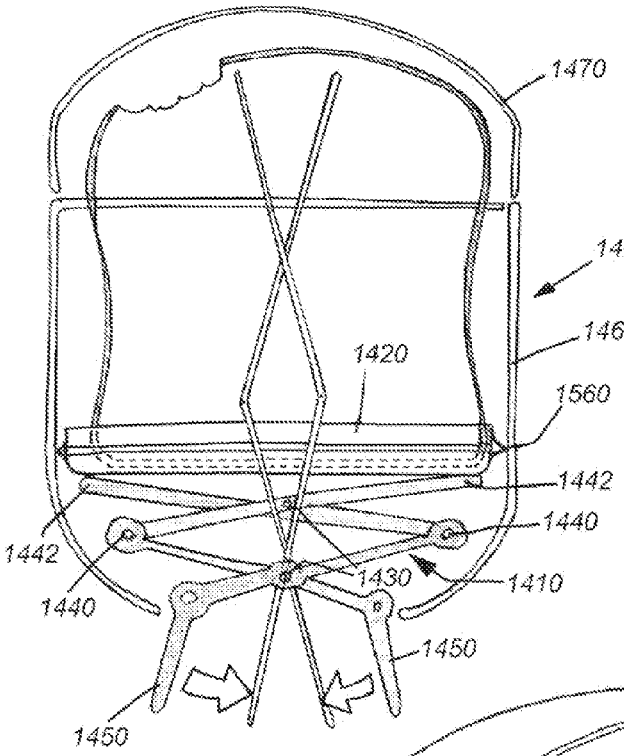
FIG. 14 is an exposed side view of a sandwich holder having an advancing mechanism including a pair of paddles interconnected to a scissors linkage which is attached to the sandwich base according to yet another alternate embodiment.
Figure 15:
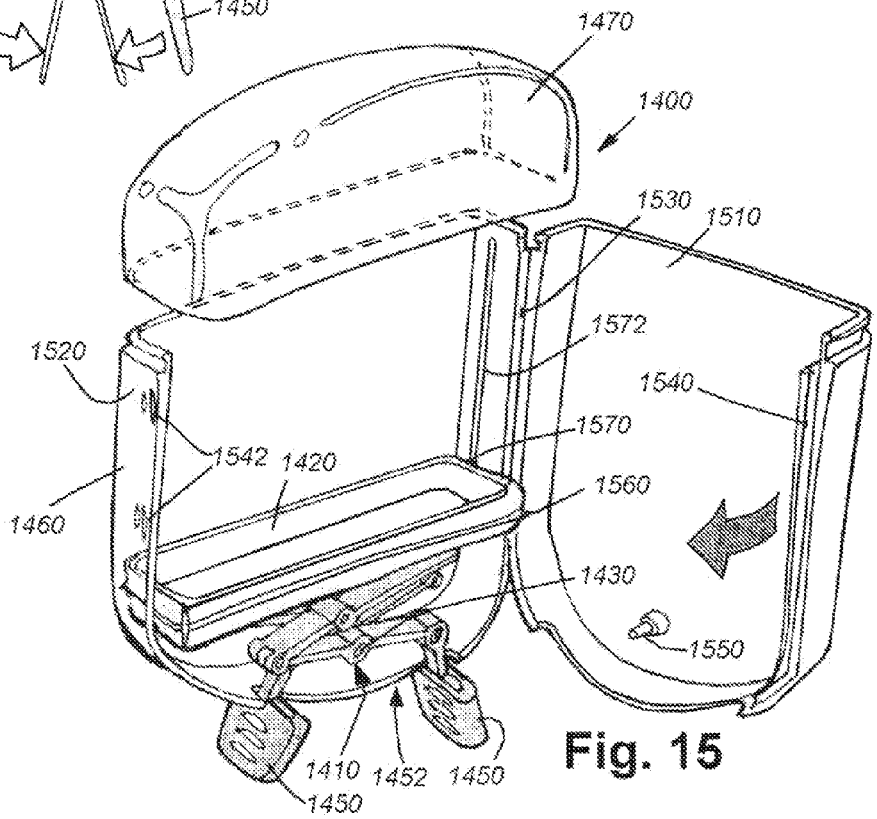
FIG. 15 is an exposed perspective view of the sandwich holder of FIG. 14 showing a hinge assembly that interconnects two confronting halves of the shell, and with the shell opened to allow access to the interior thereof.

According to yet another embodiment, shown in FIGS. 14 and 15, a sandwich holder 1400 can employ a non-geared scissor mechanism 1410 to advance and withdraw a base 1420. In this embodiment, the scissor mechanism 1410 includes a pair of central pivots 1430 between members, as well as other pivots, 1440. This assembly forms, in essence, a pantograph arrangement in which the upper members 1442 support the base 1420. In this embodiment, the upper members 1442 of the pantograph are not physically attached to the base 1420, but rather act as a supporting surface that slides along the bottom of the base as the pantograph is extended or refracted. A pair of paddles 1450 extend from the bottom of the shell, where a slotted region 1452 has been formed in each side of the shell. Notably, the shell includes a pair of front and rear shell halves, 1510 and 1520 respectively, which are joined at a live hinge 1530. The hinge is opposed by a lip 1540 on the opposite side of the shell that engages detents 1542 in the opposing shell half 1520. This allows the halves to be snap fit together during use, and detached from each other for cleaning, etc. An alternate locking mechanism (e.g. a latch) can be used to selectively secure the halves together. The front shell half 1510 also includes a pivot member 1550 that engages the main pivot point 1430 in the pantograph. The hinged arrangement as shown allows ready access and cleaning of the unit. This hinged design can be adapted to any of the embodiments shown and described above. A wiper or other seal 1560 is employed on the base 1420. In addition to, or as an alternative to such a wiper, a liner can be employed to separate the sandwich from the advancing mechanism and shell interior. A removable top 1470 is provided, and can be similar in shape and design as the others described above. The sandwich base 1420 can include projections 1570 that ride in associated guide grooves 1572. This aids in stabilizing the base as it moves upwardly and downwardly. Such guide grooves can be used in other embodiments described herein.

IV. Conclusion

Figure 16:
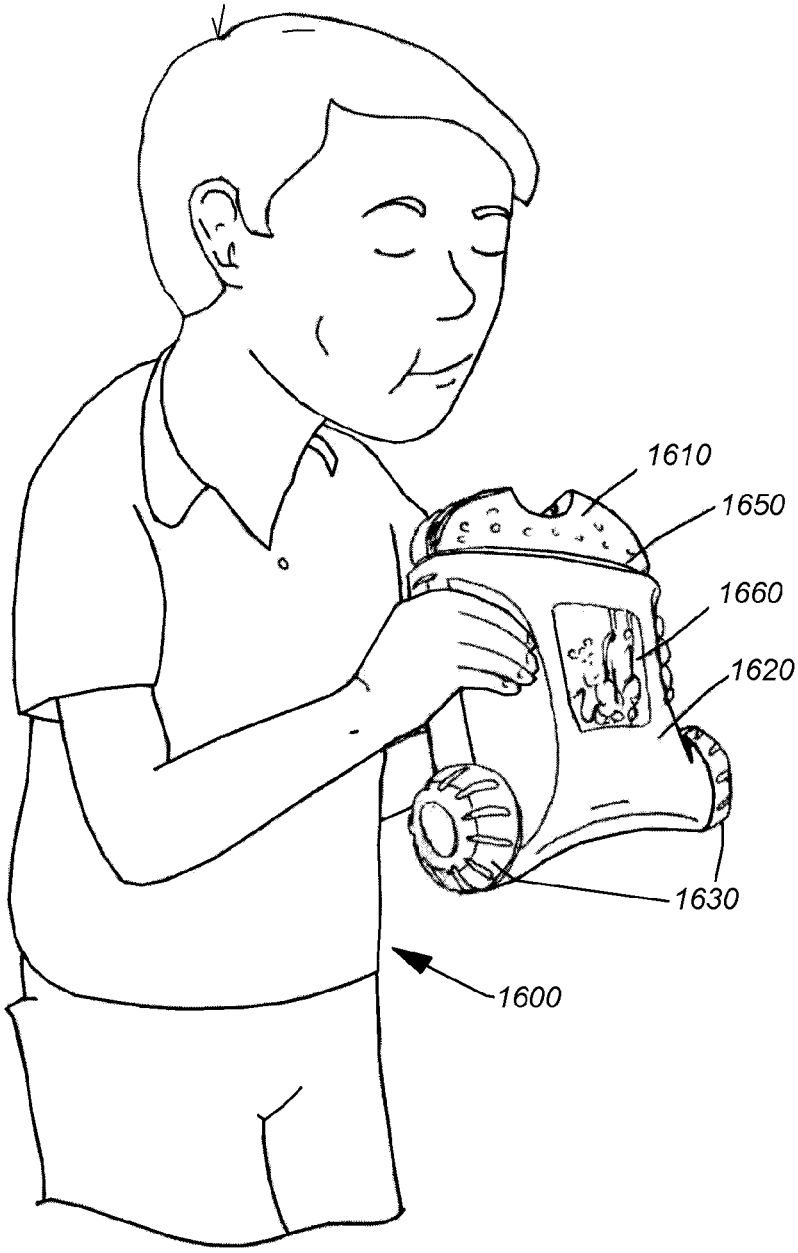
FIG. 16 is a perspective view of a human being grasping a sandwich holder according to an illustrative embodiment.

It should be clear that the sandwich holder in accordance with the various embodiments herein provides a neat, effective and hygienic solution to the problem of messy and runny sandwiches in the hands of small children and others having eating challenges. As shown in FIG. 16, the sandwich holder according to embodiments of FIGS. 1-5 (or according to the other embodiments described herein) allows the user 1600 to concentrate on a small, exposed portion of the overall sandwich 1610 while grasping a secure and entertaining holder 1620 that protects the remainder of the sandwich from the user's hands. The user is given an incentive to continue eating after the top portion is consumed through the desire to rotate the large knobs 1630, which produce more of the sandwich through the top 1650 of the holder. Likewise, the user may receive another entertaining stimulus 1660 as he or she advances the knobs 1630 in the form of a moving graphic 1660. The overall result is an enjoyable and entertaining dining experience for the user that avoids many of the desirable aspects in eating a runny or messy sandwich.

The foregoing has been a detailed description of illustrative embodiments of the invention. Various modifications and additions can be made without departing from the spirit and scope of this invention. Each of the various embodiments described above may be combined with other described embodiments in order to provide multiple features. Furthermore, while the foregoing describes a number of separate embodiments of the apparatus and method of the present invention, what has been described herein is merely illustrative of the application of the principles of the present invention. For example, the liner and/or other materials herein can be constructed using commercially available or custom-designed anti-bacterial materials. Likewise, while the height of the enclosure for holding the sandwich can vary. In alternate embodiments, the shell and advancing mechanism can be adapted to completely enclose the sandwich when the base is in a lowermost position. A flush-mounted cap can be provided over the open top end in such embodiments. Moreover, it is expressly contemplated that the shape of the base in the advancing mechanism, as well as the overall shape and scale of the shell is highly variable. Such variation in shape and size can be provided to accommodate different age and sized users as well as different sized food products. By way of example, the embodiments herein can be adapted to functionally enclose and advance other relatively flat food, such as pizza, toast, bagels, tortillas and the like. More broadly, the term "sandwich-like" shall refer to food products with such a generally flat shape that are capable of storage and dispensing by a holder in accordance with the generalized principles described herein. Accordingly, this description is meant to be taken only by way of example, and not to otherwise limit the scope of this invention.

What is claimed is:

1. A holder for sandwich-like food products comprising:

a shell having an enclosed volume and an exterior shape constructed and arranged to be grippable, the shell including an open top end;

a base that moves upwardly between a bottommost position and a topmost position within the enclosed volume, the base being constructed and arranged to receive a bottom of the sandwich-like food product; and a strip having a first end attached adjacent to a top edge of the shell and an opposing second end that is constructed and arranged to be movable in each of opposing directions, the strip cradling a bottom of the base so as to selectively allow the base to move upwardly and downwardly as the second end of the strip is moved in each of the opposing directions, and the second end of the strip is operatively connected to a spool adjacent to a bottom of the shell, wherein the strip extends from the spool around a first guide, a second guide, and the bottom of the base.

2. The holder as set forth in claim 1 wherein the second end of the strip is operatively connected to the spool that rotates to move the second end in each of the opposing directions.

3. The holder as set forth in claim 2 wherein the spool is operatively connected to an actuator assembly that includes an indexing device that selectively resists movement of the spool in at least one direction.

4. The holder as set forth in claim 2 wherein the spool is operatively connected to a knob assembly that rotates the spool.

5. The holder as set forth in claim 4 wherein the knob assembly includes a pair of knobs each located on each of opposing sides of the shell.

6. The holder as set forth in claim 1 further comprising a removable top mounted on the top edge of the shell, constructed and arranged to enclose an exposed portion of the sandwich-like product that extends outwardly beyond the top edge.

7. The holder as set forth in claim 1 further comprising a removable liner that encloses the sandwich-like product on the bottom and sides thereof and that is attached adjacent to the top edge of the shell.

8. The holder as set forth in claim 7 wherein the removable liner comprises a bag structure of polymer material that is constructed and arranged to be disposable after at least one use thereof.

9. The holder as set forth in claim 1 wherein the shell includes one of either a transparent and a translucent window and the strip includes a graphic that moves with respect to the window as the strip moves.

10. A holder for sandwich-like food products comprising:

a shell having an enclosed volume and an exterior shape constructed and arranged to be grippable, the shell including an open top end;

a base that moves upwardly between a bottommost position and a topmost position within the enclosed volume, the base being constructed and arranged to receive a bottom of the sandwich-like food product; and a strip having a first end attached adjacent to a top edge of the shell and an opposing second end that is constructed and arranged to be movable in each of opposing directions, the strip cradling the bottom of the base so as to selectively allow the base to move upwardly and downwardly as the second end of the strip is moved in each of the opposing directions;

wherein the second end of the strip is operatively connected to a spool that rotates to move the second end in each of the opposing directions, and the spool is located adjacent to a bottom of the shell and the strip extends from the spool to a first guide, along a first vertical portion to a second guide, adjacent to the top edge, around the second guide along a second vertical portion to a portion that wraps around a bottom of the base to a third vertical portion that extends to the first end of the strip.

11. The holder as set forth in claim 1 wherein the base and the shell are constructed and arranged to enclose at least a portion of a sandwich made from commercially available, rectangular sliced bread.

* * * * *